US009533871B2

(12) United States Patent
Larsson et al.

(10) Patent No.: US 9,533,871 B2
(45) Date of Patent: Jan. 3, 2017

(54) FUEL DISPENSER SYSTEM WITH SEALED PARTITION PART

(71) Applicant: Wayne Fueling Systems Sweden AB, Malmo (SE)

(72) Inventors: Bengt I. Larsson, Malmo (SE); Eva-Lie Edvardsson, Malmo (SE)

(73) Assignee: Wayne Fueling Systems Sweden AB, Malmo (SE)

( * ) Notice: Subject to any disclaimer, the term of this patent is extended or adjusted under 35 U.S.C. 154(b) by 32 days.

(21) Appl. No.: 14/278,983

(22) Filed: May 15, 2014

(65) Prior Publication Data

US 2015/0329349 A1 Nov. 19, 2015

(51) Int. Cl.

| | |
|---|---|
| ***B67D 7/12*** | (2010.01) |
| ***B67D 7/04*** | (2010.01) |
| ***F17C 5/06*** | (2006.01) |
| ***F17C 5/02*** | (2006.01) |
| ***B67D 7/32*** | (2010.01) |

(Continued)

(52) U.S. Cl.

CPC . *B67D 7/04* (2013.01); *B67D 7/32* (2013.01); *B67D 7/3236* (2013.01); *B67D 7/84* (2013.01); *F17C 5/02* (2013.01); *F17C 5/06* (2013.01); *F17C 5/007* (2013.01); *F17C 2205/0302* (2013.01); *F17C 2221/033* (2013.01); *F17C 2223/0123* (2013.01); *F17C 2223/036* (2013.01); *F17C 2265/065* (2013.01); *F17C 2270/0139* (2013.01)

(58) Field of Classification Search

CPC ..... B67D 7/3236; B67D 7/84; B67D 7/04; F17C 5/06; H01B 17/30–17/306

USPC ..... 222/71–75, 173, 183; 312/198

See application file for complete search history.

(56) References Cited

U.S. PATENT DOCUMENTS 2,364,138 A * 12/1944 Grise ..... B67D 7/84 222/173

2,552,783 A * 5/1951 Harper ..... F17C 13/02 177/116

(Continued)

FOREIGN PATENT DOCUMENTS

DE 10 2012 000774 B3 1/2013

EP 2 377 808 A1 10/2011

(Continued)

OTHER PUBLICATIONS

Housing_Definition of housing by Merriam-Webster.pdf.*

*Primary Examiner* — Patrick M Buechner

*Assistant Examiner* — Randall Gruby

(74) *Attorney, Agent, or Firm* — Mintz Levin Cohn Ferris Glovsky and Popeo, P.C.

(57) ABSTRACT

A fuel dispenser system is provided including a partition part to separate a fuel dispensing unit from at least one electrically powered component. The partition part can be configured and arranged to seal the at least one electrically powered component from exposure to gas vapors emitted from the fuel dispensing unit. The fuel dispenser unit can include a fuel dispensing nozzle and a hydraulic component. The system can include additional fuel dispensing units. The fuel dispensing nozzle can be configured to dispense CNG, and the additional fuel dispensing nozzle can be configured to dispense CNG or another type of fuel. The at least one electrically powered component may include a transaction terminal.

14 Claims, 5 Drawing Sheets

(51) Int. Cl.
*B67D 7/84* (2010.01)
*F17C 5/00* (2006.01)

(56) References Cited

U.S. PATENT DOCUMENTS 3,700,877 A * 10/1972 Wilson ..... 362/300
3,803,531 A * 4/1974 Sorensen ..... G21C 17/116 174/151
D237,823 S * 11/1975 Gray ..... D15/9.2
3,935,435 A * 1/1976 Greenwood ..... B67D 7/08 194/206
4,101,056 A * 7/1978 Mattimoe ..... B67D 7/228 222/1
D271,696 S * 12/1983 Todd ..... D15/9.2
D272,629 S * 2/1984 Monigle ..... D15/9.1
4,461,401 A * 7/1984 Sasnett, Jr. ..... B67D 7/22 222/130
4,576,312 A * 3/1986 Swick, Jr. ..... 222/27
4,662,692 A * 5/1987 Uken ..... H01R 13/5216 439/271
D301,342 S * 5/1989 Mittermaier ..... D15/9.2
4,986,445 A * 1/1991 Young et al. ..... 222/71
5,083,846 A * 1/1992 Day, Jr. ..... B67D 7/84 222/74
5,151,395 A * 9/1992 Tom ..... B01D 53/0423 502/407
5,156,199 A * 10/1992 Hartsell, Jr. ..... B67D 7/32 141/198
5,238,030 A * 8/1993 Miller et al. ..... 141/4
5,257,423 A * 11/1993 Jacobsen ..... E03B 9/20 312/228
5,452,750 A * 9/1995 Miller ..... B67D 7/84 141/302
5,569,151 A * 10/1996 Karwacki ..... B01J 4/00 137/264
5,651,478 A * 7/1997 Tatsuno ..... B67D 7/84 222/135
5,717,564 A * 2/1998 Lindale ..... 361/600
D395,052 S * 6/1998 Krone ..... D15/9.1
5,867,403 A * 2/1999 Sasnett, Jr. ..... B67D 7/08 137/2
5,911,248 A * 6/1999 Keller ..... H01B 7/16 141/59
D414,501 S * 9/1999 Wilson ..... D15/9.2
6,167,922 B1 * 1/2001 Seitz et al. ..... 141/97
6,199,579 B1 * 3/2001 Taylor et al. ..... 137/355.22
6,659,143 B1 * 12/2003 Taylor et al. ..... 141/59
6,681,814 B1 * 1/2004 Bartlett et al. ..... 141/94
6,899,149 B1 * 5/2005 Hartsell, Jr. ..... B67D 7/32 141/192
6,935,191 B2 * 8/2005 Olivier et al. ..... 73/861.79
6,959,837 B2 * 11/2005 Shermer ..... B67D 7/36 137/553
6,995,317 B1 * 2/2006 Dzurilla ..... 174/669
7,503,205 B2 * 3/2009 Baillargeon et al. ..... 73/40
7,555,935 B2 * 7/2009 Baillargeon et al. ..... 73/40.5 R
7,725,271 B2 * 5/2010 Yang ..... B67D 7/54 702/45
7,946,309 B2 * 5/2011 Reid et al. ..... 137/68.14
8,285,506 B2 * 10/2012 Oldham et al. ..... 702/85
D677,284 S * 3/2013 Helgesson ..... D15/9.2
2003/0164202 A1 * 9/2003 Graham ..... B60S 5/02 141/98
2004/0011421 A1 * 1/2004 Bartlett et al. ..... 141/94
2004/0073525 A1 * 4/2004 Stanley ..... 705/413
2005/0000588 A1 * 1/2005 Webb et al. ..... 141/94
2006/0260387 A1 * 11/2006 Baillargeon et al. ..... 73/40.5 R
2006/0260680 A1 * 11/2006 Reid et al. ..... 137/68.14
2006/0260681 A1 * 11/2006 Reid et al. ..... 137/68.14
2006/0277976 A1 * 12/2006 Baillargeon et al. ..... 73/40
2007/0109068 A1 5/2007 Smith et al.
2008/0257429 A1 * 10/2008 Nanaji et al. ..... 137/557
2008/0313062 A1 * 12/2008 Williams ..... B60S 5/02 705/30
2008/0313078 A1 * 12/2008 Payne ..... G06Q 20/40 705/44
2009/0034232 A1 * 2/2009 Larsson et al. ..... 362/96
2009/0088066 A1 * 4/2009 Zuzek et al. ..... 454/184
2009/0293989 A1 * 12/2009 Yang ..... B67D 7/067 141/83
2011/0031267 A1 * 2/2011 Liebal ..... B67D 7/08 222/1
2011/0162753 A1 * 7/2011 Bolt ..... B67D 7/54 141/1
2011/0191037 A1 * 8/2011 Oldham et al. ..... 702/45
2012/0024892 A1 * 2/2012 Bartlett ..... B67D 7/04 222/54
2012/0042967 A1 * 2/2012 Reid et al. ..... 137/526
2012/0205394 A1 * 8/2012 Larsson ..... B67D 7/84 222/74
2013/0018504 A1 * 1/2013 Oldham ..... B67D 7/145 700/231
2013/0074986 A1 * 3/2013 Larsson ..... H02G 3/22 141/311 R
2013/0110286 A1 * 5/2013 Williams ..... G06F 17/00 700/244
2014/0071073 A1 * 3/2014 Williams ..... G06F 3/0412 345/173
2014/0097577 A1 * 4/2014 Martensson et al. ..... 277/606
2014/0130901 A1 * 5/2014 Moses ..... F02B 43/00 137/343
2014/0260514 A1 * 9/2014 Williams ..... G01F 15/007 73/1.36
2014/0300372 A1 * 10/2014 Benton ..... G01R 19/165 324/537
2015/0153210 A1 * 6/2015 Bartlett ..... G01F 1/8495 141/95

FOREIGN PATENT DOCUMENTS

WO 2011/044951 A1 4/2011
WO 2014/061374 A1 4/2014

* cited by examiner

FUEL DISPENSER SYSTEM WITH SEALED PARTITION PART

FIELD

The subject matter disclosed herein relates to fuel dispensers, and in particular, dispensers that can dispense Compressed Natural Gas (CNG).

BACKGROUND

Many commercial and industrial sites are commonly classified as hazardous environments due to risk of explosion or fire. Areas involving fuel-dispensing equipment, for example, are classified as hazardous due to the types of products handled by these dispensers. A well-defined classification system for such hazardous environments has been developed, and equipment can be rated to operate in various environment classes. In one such system, areas where ignitable concentrations of flammable gases, flammable liquid-produced vapors, or combustible liquid-produced vapors can exist under normal operating conditions and/or where hazard is caused by frequent maintenance or repair work or frequent equipment failure are classified as Class I, Division 1. One such environment is the inside of the hydraulic cabinet of a gasoline dispenser. In such environments, electronics are required to be "explosion proof" or "intrinsically safe," meaning that they cannot create a spark capable of ignition even in the case of a fault of electronics.

Areas where ignitable concentrations of flammable gases, flammable liquid-produced vapors, or combustible liquid-produced vapors are not normally present, but may exist due to an accidental rupture or breakdown, are classified as Class I, Division 2. This typically includes areas adjacent to Class I, Division 1 areas. The immediate area around a dispenser would be an example of such an area. Electronics used in this area are required to not be able to produce a spark capable of ignition under normal operating conditions.

The type of fuel dispensed determines the classification of the hazardous zones in and around the dispenser. Fuels with vapors that are heavier than air differ from those with properties that are lighter than air and thus create different zones. For example, CNG is lighter than gasoline/diesel vapor and behaves differently. As such, CNG dispensers must meet different (more stringent) safety requirements than, for example, gasoline or diesel dispensers.

Electronics must be designed to meet the requirements of the zone in which they will reside. In some cases this can be expensive (e.g., the design of Intrinsically Safe Barriers or Explosion-proof boxes) and, in still other cases, it may be difficult to design or protect the electronics so as to perform the desired function while meeting the zone requirements (e.g., the design of a receipt printer to be used in a Class I, Division 1 area).

Natural gas is considered to be a greener energy source than gasoline due to its lower emission profile. Its adaptation, however, has been relatively slow due to a lack of distribution network. Whereas gasoline stations are nearly ubiquitous, natural gas (e.g., CNG or Liquefied Natural Gas (LNG)) fueling stations are sparse. One reason for this is due to the high cost required to implement natural gas dispensers, which requires, for example, specially designed electronics as discussed above.

To avoid the high cost of electronics specially designed to meet the environment requirements, some current CNG dispensers are physically separated from dispensers of other fuels such as gasoline, diesel, or additives. Some current CNG dispensers exclude electronics, such as payment/media terminal. Some current CNG dispensers require venting around the electronic module, for example, at the payment terminal.

Accordingly, there remains a need for a dispenser system that can utilize cheaper electronics that are not specially designed for operation in a classified hazardous environment while being safely deployed in such an environment. There is also a need for a combined fuel dispensing system that can dispense more than one type of fuel.

BRIEF DESCRIPTION

Dispenser systems and methods are provided in which the electronics are sealed from potential exposure to hazardous conditions such as fuel vapors. Such a system can enable the use of more widely available electronics in a hazardous environment. Such a system can also enable existing fuel dispenser systems to be upgraded to dispense additional fuel types by allowing the existing electronics to safely work in the additionally hazardous environment. This could lower the cost of implementing, for example, natural gas fuel stations, and could accelerate the adaptation of cleaner energy sources. Moreover, the fuel dispenser systems disclosed herein can increase the efficiency, longevity, and safety of electronics operating within a hazardous environment. Such systems can have particular utility in fuel dispensing applications, such as dispensers for gasoline, CNG, LNG, and diesel, but can also be applied broadly to any application where it is necessary to reduce the risk of fire or explosion caused by electrical components in a hazardous environment.

In one aspect, a fuel dispensing system is provided. The fuel dispenser system can include at least one electrically powered component housed in a first housing, a second housing comprising a fuel dispensing unit including a nozzle and optionally a hydraulic component, and a partition part arranged between the first and second housings. The partition part can configured and arranged to seal the at least one electrically powered component from exposure to gas vapors emitted from the fuel dispensing unit. The system can further include one or more additional fuel dispensing units for dispensing one or more types of fuel. For example, the system can include a third housing disposed on a side of the first housing opposite to the second housing, and having a nozzle coupled thereto.

In some embodiments, the at least one electrically powered component is not rated for operation in a hazardous area. In some embodiments, the fuel dispensing unit dispenses CNG, and the at least one electrically powered component may not be rated for operation with CNG. In some embodiments, the partition part can form a wall of a partition housing having a width to space the fuel dispensing unit, for example, horizontally at a distance away from the housing or enclosure containing the at least one electrically powered component. The width may be, for example, at least 200 mm. In some embodiments, the partition housing can have a coffin shape, and/or the partition part may form a hermetic seal with the partition housing. By way of non-limiting example, the partition part can be a gas impermeable material. In some embodiments, the partition housing defines one or more recesses to accommodate a nozzle.

In some embodiments, the at least one electrically powered component can be a payment terminal. The payment terminal can include, for example, a display and/or a printer.

As explained in more detail below, such a system can also include a number of other features and/or modifications.

In another aspect, a method of dispensing a fuel is provided. The method can include providing at least one electrically powered component housed in a first housing, providing a fuel dispensing unit, and providing and arranging a partition part between the fuel dispensing unit and the at least one electrically powered component. The partition part can be configured and arranged to seal the at least one electrically powered component from exposure to gas vapors emitted from the fuel dispensing unit.

In some embodiments, the at least one electrically powered component is not rated for operation in a hazardous area. In some embodiments, the method can further include providing a further fuel dispensing unit. In some embodiments, the fuel dispensing unit dispenses CNG and the at least one electrically powered component is not rated for use in a CNG environment.

BRIEF DESCRIPTION OF THE DRAWINGS

These and other features will be more readily understood from the following detailed description taken in conjunction with the accompanying drawings, in which.

Figure 1:
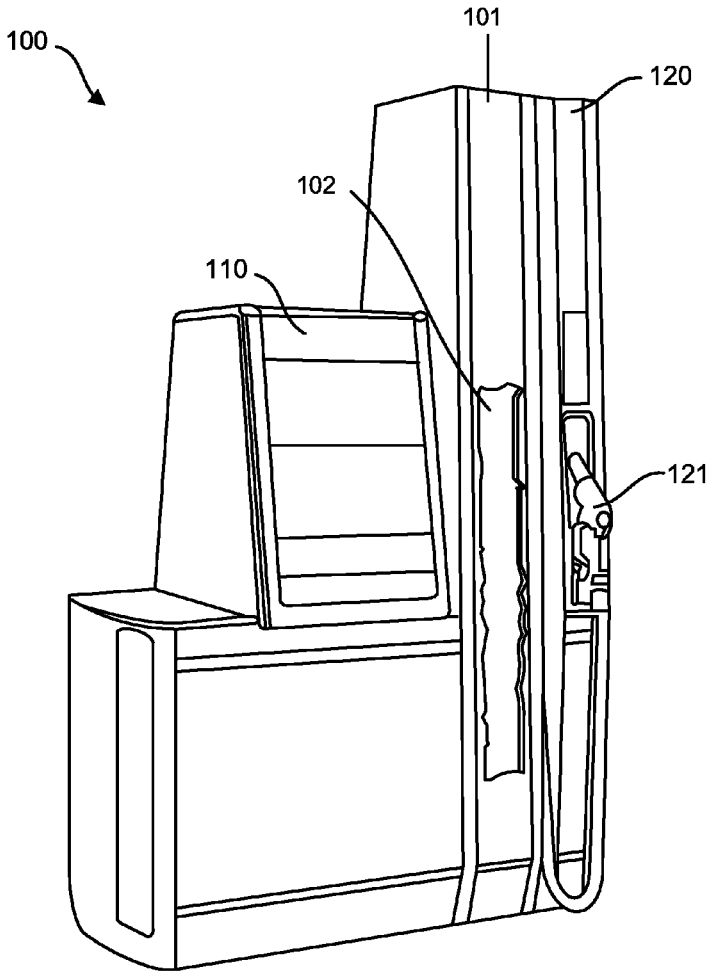
FIG. 1 is an illustration of one embodiment of a fuel dispenser system.

It is noted that the drawings are not necessarily to scale. The drawings are intended to depict only typical aspects of the subject matter disclosed herein, and therefore should not be considered as limiting the scope of the disclosure. In the drawings, like numbering represents like elements between the drawings.

DETAILED DESCRIPTION

Certain exemplary embodiments will now be described to provide an overall understanding of the principles of the structure, function, manufacture, and use of the devices, systems, and methods disclosed herein.

Fuel dispenser systems are provided that can utilize non-specialized electronics (e.g., existing/standard electronics designed for dispenser systems of different or less hazardous fuel) while complying with the requirements for use in an environment classified as hazardous due to the presence of explosive gases. Such systems can be used, for example, to protect and allow for the use of electronic components that are otherwise not rated or designed for use in the hazardous environment. For example, the systems described herein can include a nozzle for dispensing CNG while utilizing electronics that are not specially designed for such a hazardous environment.

FIG. 1 illustrates one embodiment of a fuel dispenser system. System 100 generally includes a first housing in the form of an electronics module 110. The electronics module 110 can contain various electronics, including one or more of, for example, a processor, computer memory, display, input device such as a keypad, credit card and/or cash receiver, printer, and other electrically powered components. System 100 also includes a second housing in the form of a CNG module 120, a CNG nozzle 121 that is coupled to the CNG module 120, and a partition housing 101 having a sealed partition part 102 located between the electronics module 110 and the CNG module 120. The sealed partition part 102 forms one wall of the partition housing 101 (as shown for illustration purposes by the cutaway in the housing), and the part 102 is configured and arranged to separate and seal (protect) the electronics module 110 from the CNG module 120. For example, in some embodiments, the sealed partition part 102 is configured to prevent the electronics module 110 from being exposed to the gas vapors that may be emitted from the CNG module/nozzle 120/121. In some embodiments, the sealed partition part 102 provides a hermetic seal in the housing 101 to act as a barrier from exposing internal electrical components of the electronics module 110 to any gas vapors.

Figure 2:
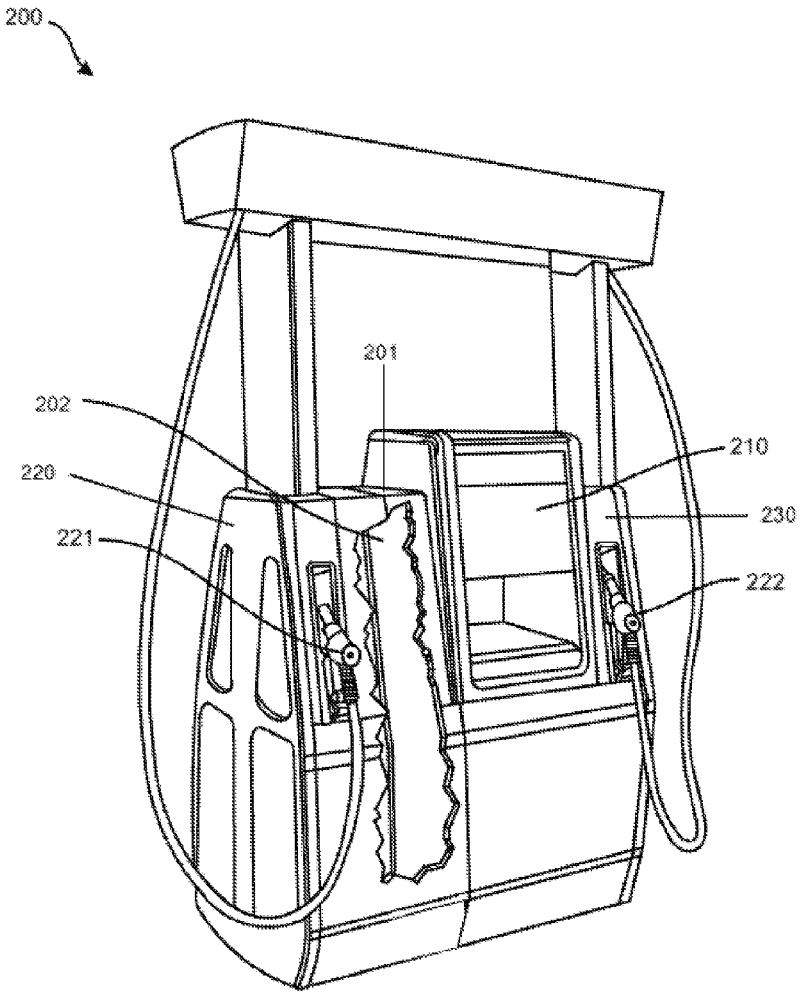
FIG. 2 is an illustration of another embodiment of a fuel dispenser system.

FIG. 2 illustrates another embodiment of a fuel dispenser system. System 200 generally includes a first housing in the form of an electronics module 210 and a second housing in the form of a CNG module 220. A CNG nozzle 221 is coupled to and seated within the CNG module 210 on one side of the first housing, and a sealed partition part 202 (as shown for illustration purposes by the cutaway in the housing) is located inside a partition housing 201 positioned between the CNG module 220 and the electronics module 210. On the other side of the electronics module 210, the system includes a fuel nozzle 222 coupled to and seated within a third housing 230 for dispensing another type of fuel such as gasoline or diesel. In some embodiments, the electronics module 210 may be selected from a design that is compatible with fuel nozzle 222 for dispensing, for example, gasoline or diesel. Since gasoline and diesel dispensers are ubiquitous, such electronics module are readily available. By providing the sealed partition part 201 that seals the electronics module 210 from potentially hazardous conditions associated with nozzle 221 (such as vapors emitted therefrom), the electronics module 210 does not need to be specially designed or constructed to meet the requirements of such hazardous environment. In some embodiments, the partition part 201 separates CNG hydraulic components from the part of the dispenser that contains the electronics module 210.

Figure 3:
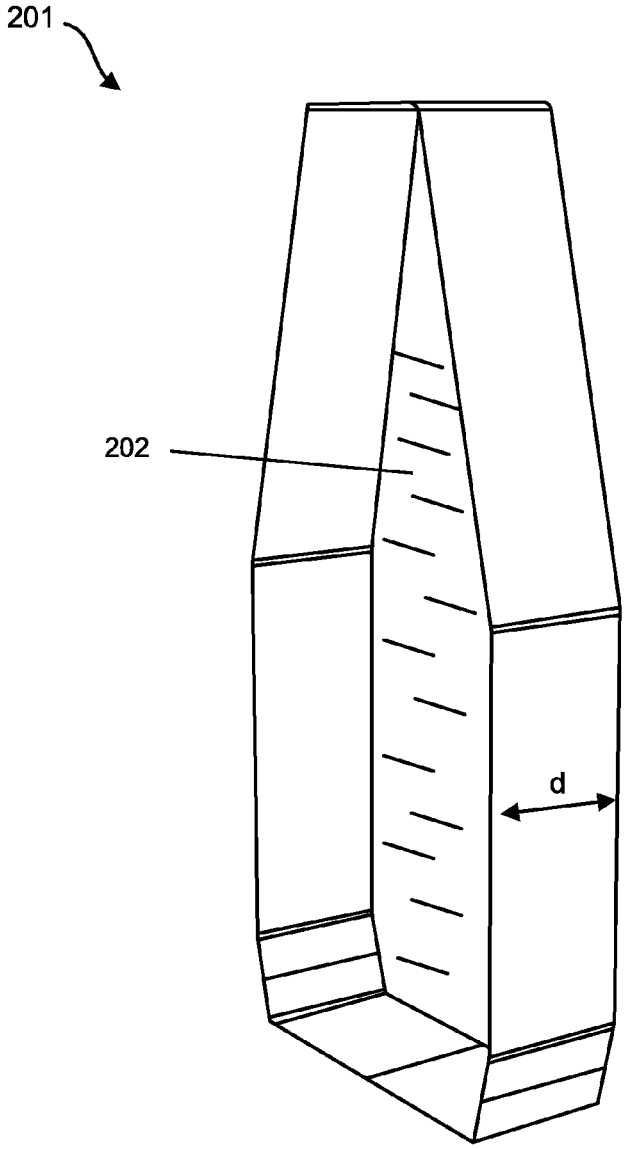
FIG. 3 is an isolation view of a partition housing of the fuel dispenser system shown in FIG. 2.

FIG. 3 shows the partition housing 201 including sealed partition part 202 in isolation. As shown, the partition housing 201 can have a shape that matches the shape of the dispenser system. In this embodiment, partition housing 201 has the shape of a coffin, e.g., with eight sides. In some embodiments, partition housing 201 can have a depth d in the range of 100 to 300 mm, and more preferably of about 200 mm, which is particularly useful for CNG dispenser applications. Partition housing 201 can have a solid volume. Alternatively, partition housing 201 can have a hollow core with left and right side walls that form an enclosed cavity, or with only one of the left and right side walls being present such that the partition housing 201 is open on one side only as shown. In some embodiments, partition housing 201 can be formed from or include a fire retardant material and/or a material that is impermeable to gas vapors (e.g., CNG, gasoline, diesel, etc.). The partition housing 201 can also be configured in different shapes and sizes depending on the dispenser system and the requirements.

Figure 4:
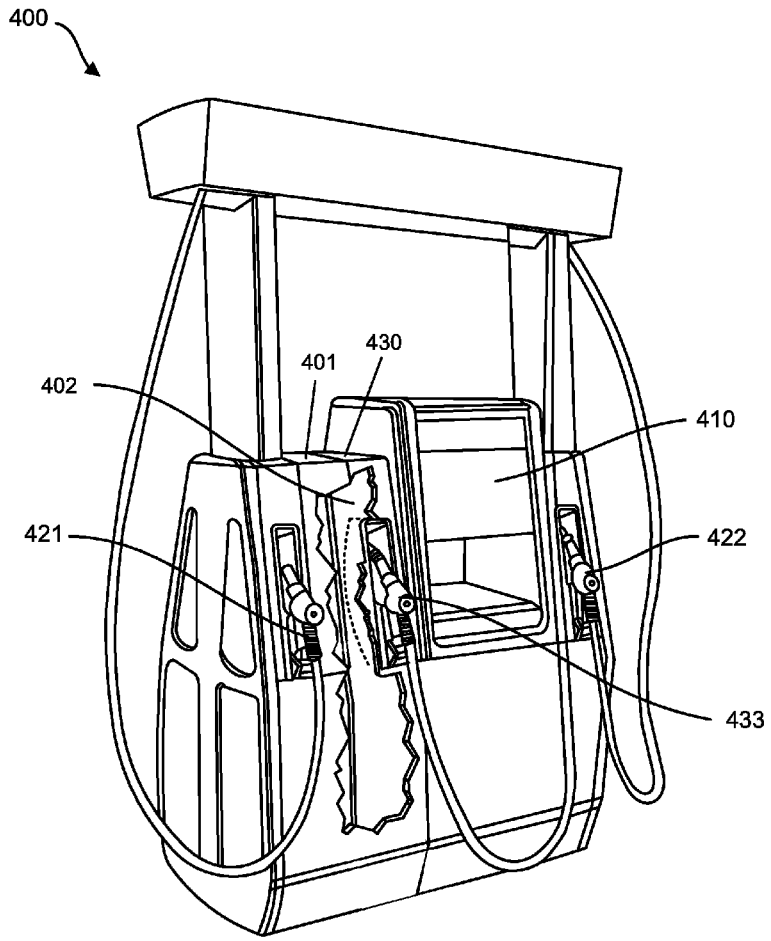
FIG. 4 is an illustration of yet another embodiment of a fuel dispenser system.

FIG. 4 shows yet another embodiment of a fuel dispenser system 400 that is similar to the system shown in FIG. 2, except that in this embodiment the system includes an additional nozzle 433 coupled to and seated in a third housing 430 provided between a partition housing 401 having a partition part 402 and an electronics module 410. To accommodate nozzle 433, partition part 402 is provided with a recess for receiving (at least partially) nozzle 433.

Figure 5:
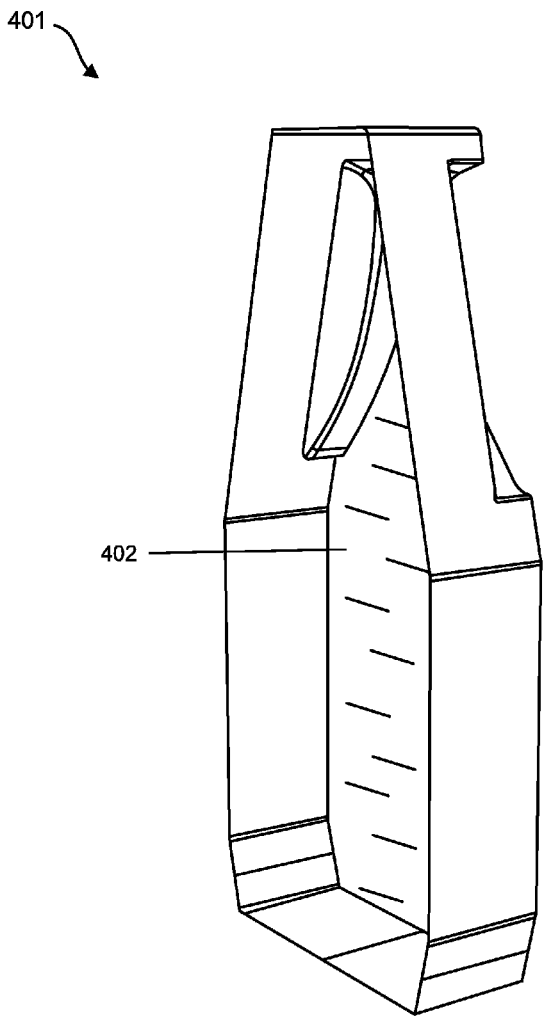
FIG. 5 is an isolation view of a partition housing of the fuel dispenser system shown in FIG. 4.

FIG. 5 shows partition housing 401 including a partition part 402 of FIG. 4 in isolation. As can be seen, partition part 402 can be provided with multiple recesses to accommodate multiple nozzles (for example, one on each side of the system 400). In other embodiments, partition part 402 can have other shapes and/or sizes to accommodate different nozzles or to conform to the configuration of the dispenser system.

In some embodiments, one or more components of the fuel dispensing system can be modular. For example, a nozzle can be part of a dispensing module, which can be replaced by another dispensing module to dispense, for example, a different type of fuel. The partition housing can also be configured as a module so that it can be, for example, interchanged with other modules. In some embodiments, a plurality of partition housings can be provided and arranged in different configurations. For example, in some embodiments, a plurality of partition parts can be placed next to each other in order to form a stronger and/or thicker barrier. In some embodiments, partition housings can be deployed on different sides of the electronics (e.g., one on each side) depending on the desired configuration.

In some embodiments, the partition housing(s) can be added to existing gasoline and/or diesel dispensing systems to allow those systems to dispense natural gas (e.g., instead of or in addition to the previous fuel) without the need to replace some or all of the electronics.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fuel dispenser system, comprising:

a first housing having at least one electrically powered component housed therein;

a second housing and a nozzle coupled to the second housing; and a partition housing arranged between the first and second housings such that the first housing is disposed entirely on one side of the partition housing and the second housing is disposed entirely on another side of the partition housing, the partition housing extending vertically such that the first and second housings are spaced apart horizontally, and the partition housing being configured and arranged to seal the at least one electrically powered component in the first housing from exposure to gas vapors emitted from the nozzle.

2. The system of claim 1, wherein the partition housing includes a partition part and an outer sidewall that extends around an entire perimeter of the partition part.

3. The system of claim 2, wherein the partition part forms a hermetic seal with the outer sidewall.

4. The system of claim 2, wherein the partition part comprises a gas impermeable material.

5. The system of claim 2, wherein the partition part defines one or more recesses to accommodate one or more nozzles.

6. The system of claim 1, further comprising a third housing disposed on a side of the first housing opposite to the second housing, the third housing including a nozzle coupled thereto.

7. The system of claim 1, wherein the partition housing has a width that spaces the second housing at a distance away from the first housing.

8. The system of claim 1, wherein the partition housing has eight sides.

9. The system of claim 1, wherein the at least one electrically powered component comprises a payment terminal.

10. The system of claim 9, wherein the payment terminal comprises a display and a printer.

11. The system of claim 1, wherein the partition housing has a width of at least 200 mm to space the second housing at least 200 mm away from the first housing.

12. A method of dispensing a fuel, comprising:

activating a fuel dispenser to cause compressed natural gas to be delivered from a nozzle coupled to a first housing, wherein a vertically extending partition part is arranged between the first housing and a second housing having at least one electrically powered component such that the first housing is disposed entirely on one side of the partition part and the second housing is disposed entirely on another side of the partition part, and wherein the vertically extending partition seat seals the at least one electrically powered component from exposure to gas vapors emitted from the nozzle.

13. The method of claim 12, wherein the partition part forms a wall of a partition housing that spaces the first housing a horizontal distance away from the second housing to prevent the at least one electronically powered component from exposure to gas vapors emitted from the nozzle.

14. The method of claim 12, wherein the fuel dispenser includes a third housing configured to dispense gasoline, the third housing be positioned on a side of the partition part that is opposite to the first housing.

* * * * *